US007455333B2

(12) United States Patent
Ookawara

(10) Patent No.: US 7,455,333 B2
(45) Date of Patent: Nov. 25, 2008

(54) SIDE LOCK APPARATUS

(75) Inventor: Toshihiko Ookawara, Kanagawa (JP)

(73) Assignee: Piolax Inc., Kanagawa (JP)

( * ) Notice: Subject to any disclaimer, the term of this patent is extended or adjusted under 35 U.S.C. 154(b) by 0 days.

(21) Appl. No.: 11/540,960

(22) Filed: Oct. 2, 2006

(65) Prior Publication Data

US 2007/0080542 A1 Apr. 12, 2007

(30) Foreign Application Priority Data

Oct. 3, 2005 (JP) ..... P2005-289959

(51) Int. Cl.
*E05C 1/06* (2006.01)

(52) U.S. Cl. ..... 292/34; 292/36

(58) Field of Classification Search ..... 292/34, 292/36, 37, 46, 165, DIG. 31
See application file for complete search history.

(56) References Cited

U.S. PATENT DOCUMENTS 926,173 A * 6/1909 Cassidy ..... 292/40
4,387,917 A * 6/1983 Cocker ..... 292/40
5,586,795 A * 12/1996 Sasaki ..... 292/336.3
6,708,537 B1 * 3/2004 Eschweiler et al. ..... 70/208
7,182,373 B2 * 2/2007 Yamada ..... 292/32
2004/0256859 A1 * 12/2004 Yamada ..... 292/32

FOREIGN PATENT DOCUMENTS

JP 2004-211383 7/2004

* cited by examiner

*Primary Examiner*—Gary Estremsky
(74) *Attorney, Agent, or Firm*—McGinn IP Law Group PLLC

(57) ABSTRACT

A side lock apparatus comprises a retainer, a rotor rotatably supported on the retainer, a pair of rods which are brought into engagement with positions which are point symmetrical relative to an axial center of the rotor at proximal end portions thereof and are supported in such a manner that distal end portions thereof appear from and disappear into both ends of a lid so as to be brought into engagement with and disengagement from a circumferential edge of an opening, a knob supported on the retainer in such a manner as to be pushed and pulled on and a return spring mounted on the rotor. When the knob is pulled on, since a pusher element of the knob pushes on a bearing portion of the rotor, the rotor rotates against the biasing force of the return spring, whereby the rods are withdrawn into the inside of the lid.

2 Claims, 12 Drawing Sheets

SIDE LOCK APPARATUS

This application is based on Japanese Patent Application No. 2005-289959, which is incorporated herein by reference.

BACKGROUND OF THE INVENTION

1. Field of the Invention

The present invention relates to, for example, a side lock apparatus which locks a lid provided in an opening in a motor vehicle in a closed state or releases the lock to open the lid.

2. Description of the Related Art

A glove box is provided on a passenger seat side of an instrument panel of a motor vehicle. A lid of this glove box is mounted in such a manner as to cover and uncover an opening in the instrument panel, and furthermore, a lock apparatus is provided which locks the lid in a closed state and releases the lock to open the lid.

As the lock apparatus of this type, there are known a center-lock type lock apparatus and a side-lock type lock apparatus. As the side-lock type lock apparatus, a side lock apparatus is disclosed in JP-A-2004-211383 below which has a case, a knob rotatably mounted on the case, a pair of sliding members which are supported on the case in such a manner as to slide in a horizontal direction and a pair of rods which are mounted on the sliding members, respectively, and are made to appear from and disappear into both left and right ends of a lid. In addition, a rack groove is formed in each of the pair of sliding members, and a pinion gear is interposed in each of the rack grooves, whereby when one of the sliding member is caused to slide by operating the knob to rotate, the other sliding member is also caused to slide as a result of interlinkage therewith, so that the pair of rods are made to appear from and disappear into both the ends of the lid through the operation of the knob.

In the case of the side lock apparatus disclosed in JP-A-2004-211383 above, however, since the other sliding member is caused to slide via the pinion gear as a result of interlinkage with the sliding of the one of the sliding members, there has occurred a case where the lid cannot be opened and closed in a smooth fashion. In addition, in the event that there exists a play or looseness between the rack groove and the pinion gear, there is caused a difference in operating stroke between the pair of rods, and in this case, too, there is caused a problem with the opening and closing operation of the lid.

SUMMARY OF THE INVENTION

An object of the invention is to provide a side lock apparatus which enables the implementation of smooth opening, closing and locking operations of the lid by causing the pair of rods to follow properly the operation of the knob for smooth operation thereof.

With a view to attaining the object, according to a first aspect of the invention, there is provided a side lock apparatus comprising: a lid for covering and uncovering an opening of a vehicle; a rotor rotatably supported on a rear side of the lid; a pair of rods which are brought into engagement with positions which are point symmetrical relative to an axial center of the rotor at proximal end portions thereof and are supported in such a manner that distal end portions thereof appear from and disappear into both ends of the lid so as to be brought into engagement with and disengagement from a circumferential edge of the opening; a knob mounted on a front side of the lid in such a manner as to be pushed and pulled on, so as to cause the rotor to rotate by being operated to be pushed and pulled on; and a return spring mounted on so as to rotationally bias the rods in a direction in which the rods are caused to protrude from both the ends of the lid, wherein the rotor rotates against the return spring by pushing and pulling on the knob, so that the rods are withdrawn into the lid.

According to the first aspect of the invention, when the lid is closed, the distal end portions of the rods protrude from both the ends of the lid by virtue of the biasing force of the return spring so as to be brought into engagement with the circumferential edge of the opening, whereby the lid can be held in the closed state. In addition, the rotor is caused to rotate against the biasing force of the return spring by pushing and pulling on the knob disposed on the front side of the lid, whereby the rods are made to be withdrawn into the lid, so that the engagement of the rods with the circumferential edge of the opening is released, and the lid can be opened.

Since the lid can be opened by pushing and pulling on the knob in this way, the operation becomes easy. In addition, the proximal end portions of the rods are in engagement with the rotor, whereby the pair of rods are made to follow properly the rotation of the rotor and hence can operate at the same time as the rotation of the rotor, and there is caused no difference in operation stroke of each of the rods. Therefore, there is produced neither play nor looseness when the knob is operated, thereby making it possible to open and close the lid smoothly and securely.

According to a second aspect of the invention, there is provided a side lock apparatus as set forth in the first aspect of the invention, wherein the knob comprises a pusher element, wherein the rotor comprises a bearing portion, wherein at least one of the pusher element and the bearing portion is extended so as to pass through an opening in the lid so that both the pusher element and the bearing portion are brought into abutment with each other, and wherein the pusher element pushes on the bearing portion to thereby cause the rotor to rotate by pushing and pulling on the knob.

According to the second aspect of the invention, since the pusher element provided on the knob is made to be brought into abutment with the bearing portion of the rotor, force resulting from the pushing and pulling operation of the knob is transmitted to the rotor effectively, whereby the rods are operated more smoothly and hence the lid is opened and closed more smoothly.

According to a third aspect of the invention, there is provided a side lock apparatus as set forth in the second aspect of the invention, wherein the knob is rotatably supported via a support shaft which is substantially parallel to the lid. According to a fourth aspect of the invention, there is provided a side lock apparatus as set forth in the second aspect of the invention, the pusher element is made to push on the bearing portion so as to cause the rotor to rotate by pulling on the knob. According to a fifth aspect of the invention, there is provided a side lock apparatus as set forth in the second aspect of the invention, wherein at least one of respective contact surfaces of the pusher element on the knob and the bearing portion on the rotor is formed into the shape of an arc.

According to the third to the fifth aspect of the invention, since at least one of the respective contact surfaces of the pusher element on the knob and the bearing portion on the rotor is formed into the shape an arc, even in the event that the rotor is caused to rotate in association with the operation of the knob, due to the contact position on the arc-shaped surface changing, sliding on the contact surfaces is reduced so as to reduce frictional resistance, whereby the knob can be operated smoothly with a light operating feeling.

According to a sixth aspect of the invention, there is provided a side lock apparatus as set forth in the fifth aspect of the invention, wherein both of the respective contact surfaces of the pusher element on the knob and the bearing portion on the rotor are formed into the shape of an arc, and wherein the contact surfaces of the pusher element and the bearing portion have a same radius of curvature.

According to the fourth aspect of the invention, since both of the respective contact surfaces of the pusher element on the knob and the bearing portion on the rotor are formed into the shape of an arc and the contact surfaces of the pusher element and the bearing portion are made to have the same radius of curvature, even in the event that the rotor rotates in association with the operation of the knob, no slippage is produced between the contact surfaces, and the pusher element of the knob pushes on the bearing portion of the rotor while producing rolling contact therebetween. Therefore, the frictional resistance can be reduced, and thus enabling a light operation of the knob. Moreover, since the wear of the pusher element of the knob and the bearing portion of the rotor is reduced, the durability can be increased.

According to a seventh aspect of the invention, there is provided a side lock apparatus as set forth in the first aspect of the invention, further comprising a retainer, the retainer including: a mounting portion which is fixed to the rear side of the lid; a rotatably knob supporting portion which rotatably supports the knob; and a rotatably rotor supporting portion which rotatably supports the rotor, wherein the knob and the rotor are mounted on the retainer.

According to the seventh aspect of the invention, since the rotor and the knob can be mounted only by assembling the rotor and the knob on to the retainer in advance and fixing the retainer on the rear side of the lid, the efficiency of mounting work of the side lock apparatus can be increased.

According to an eighth aspect of the invention, there is provided a side lock apparatus as set forth in the first aspect of the invention, further comprising an engagement portions with which the proximal end portions of the rods are brought into engagement are provided on an opposite side of the rotor to a side thereof where the rotor is rotatably supported on the lid.

According to the eighth aspect of the invention, since the engagement portions with which the rods are brought into engagement are provided on the opposite side of the rotor to the side thereof where the rotor is rotatably supported on the lid, when the rotor rotates, the rotor is made difficult to be brought into interference with the other members such as the knob, and the height of the side lock apparatus when mounted can be lowered as much as possible, thereby making it possible to make the side lock apparatus smaller in size.

According to a ninth aspect of the invention, there is provided a side lock apparatus as set forth in the seventh aspect of the invention, wherein the rotor comprises a pair of extending portions which are caused to extend radially outwards from facing portions on an outer circumference thereof, wherein an arc-shaped elongated projection which is centered at a rotational center of the rotor is provided on either of contact surfaces of the extending portions and the retainer, and wherein the engagement portions with the rods are provided on an opposite side of the extending portions to a side thereof where the extending portions are brought into contact with the retainer.

According to the ninth aspect of the invention, since the arc-shaped elongated projection which is centered at the rotational center of the rotor is provided on either of the contact surfaces of the extending portions of the rotor and the retainer, the contact area between the rotor and the retainer is reduced so as to reduce the frictional resistance against the rotation of the rotor, thereby making it possible to make the rotational operation smooth. In addition, since the engagement portions with the rods are provided on the opposite side of the extending portions to the side thereof where the extending portions are brought into contact with the retainer, the inclination of the rotor can be suppressed so as to support the rods stably.

According to the tenth aspect of the invention, there is provided a side lock apparatus as set forth in the seventh aspect of the invention, wherein the rotor comprises a notched portion at, at least, a location on a circumferential edge portion thereof, an erectly standing wall is provided on the retainer which is situated outwards of the rotor and is caused to extend over a length which exceeds the thickness of the rotor and which comprises at a distal end thereof a claw portion adapted to be brought into engagement with a rear surface side of the rotor, whereby when the rotor is mounted on the retainer, the claw portion is made to protrude to the rear surface side of the rotor through the notched portion, and the rotor is caused to rotate in that state, so that the claw portion is brought into engagement with a circumferential edge of the rotor to thereby prevent the dislodgement of the rotor, and wherein a rotation restricting means is provided between the retainer and the rotor which prevents the return of the notched portion of the rotor to the claw portion of the retainer when the rotor is mounted on the retainer and is then caused to rotate and which permits the rotation of the rods within a predetermined angular range which enables the rods to appear from and disappear into both the ends of the lid.

According to the tenth aspect of the invention, since the notched portion of the rotor is aligned with the claw portion of the erectly standing wall formed on the retainer, the rotor is pushed into the rotatably rotor supporting portion of the retainer sodas to be mounted thereon, and thereafter the rotor is caused to rotate so as to be held in the dislodgement preventive state, the mounting work of the rotor on to the retainer can be implemented easily and quickly.

According to the side lock apparatus of the invention, when the lid is closed, the distal end portions of the rods protrude from both the ends of the lid to thereby be brought into engagement with the circumferential edge portion of the opening, so as to hold the lid in the closed state, and by pushing and pulling on the knob the rotor is caused to rotate so that the rods are withdrawn into the lid, whereby the engagement with the circumferential edge of the opening is released, so that the lid can be opened.

Since the lid can be opened by pushing and pulling on the knob in this way, the operation is made easy. In addition, since the proximal end portions of the rods are brought into engagement with the rotor, the pair of rods follow properly the rotation of the rotor and operate at the same time as the rotation of the rotor, and there is produced no difference in operation stroke of each of the rods, there is produced neither play nor looseness when the knob is operated, and the opening and closing operation of the lid can be implemented smoothly and securely.

BRIEF DESCRIPTION OF THE DRAWINGS

FIGS. 2A and 2B are diagrams showing a glove box in which the side lock apparatus of the invention is mounted, wherein FIG. 2A is a perspective view of the side lock apparatus, and FIG. 2B is a partially cutaway perspective view resulting when seen from a back side of FIG. 2A;

FIGS. 3A and 3B are diagrams showing a retainer of the side lock apparatus, wherein FIG. 3A is a perspective view of the retainer, and FIG. 3B is a perspective view resulting when seen from a bottom side of FIG. 3A;

FIGS. 4A and 4B are diagram showing a knob of the side lock apparatus, wherein FIG. 4A is a perspective view of the knob, and FIG. 4B is a perspective view resulting when seen from a bottom side of FIG. 4A;

FIGS. 5A and 5B are diagrams showing a rotor of the side lock apparatus, wherein FIG. 5A is a perspective view of the rotor, and FIG. 5B is a perspective view resulting when seen from a bottom side of FIG. 5A;

FIGS. 11A and 11B are diagrams showing operations of a pusher element of the knob and a bearing portion of the rotor in the side lock apparatus, wherein FIG. 11A is an explanatory diagram in the state in which the lid is locked, and FIG. 11B is an explanatory diagram in the state in which the lid is released from the locked state.

DETAILED DESCRIPTION OF THE PREFERRED EMBODIMENTS

Hereinafter, referring to FIGS. 1 to 11, an embodiment of a side lock apparatus of the invention will be described.

Figure 2A:
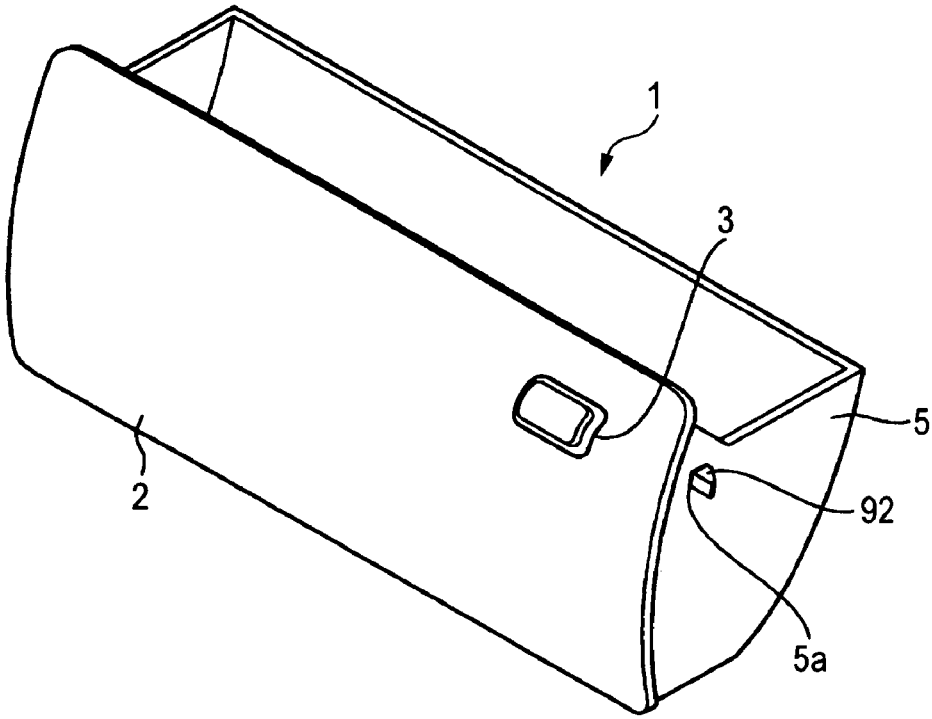
Figure 2B:
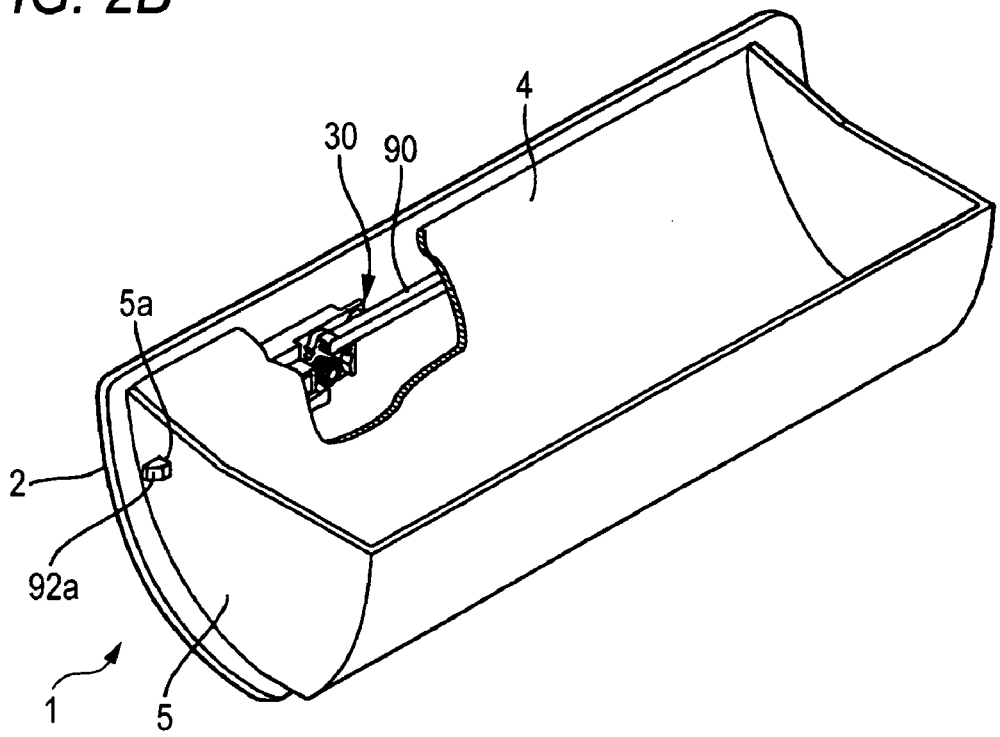

This side lock apparatus is applied to, for example, a lid 2 for a box-shaped glove box 1 provided in an opening in an instrument panel of a motor vehicle (refer to FIGS. 2A and 2B). Support shafts or the like, not shown, are provided in lower positions on both ends of the glove box 1 in such a manner as to protrude therefrom, and the support shafts so provided are then inserted into shaft holes, not shown, which are provided in lower positions on both ends of an opening 6 (refer to FIGS. 9, 10) in the instrument panel, whereby the lid 2 of the glove box 1 is made to cover and uncover the opening 6. A mounting opening 3 which passes through the lid 2 is provided at a predetermined location on the lid, and a side lock apparatus 10 of the invention is mounted in this mounting opening 3.

Note that in the case of this embodiment, while the side lock apparatus is applied to the lid of the box-shaped glove box which can accommodate therein articles, the side lock apparatus may be applied to a lid such as a lid element adapted to cover and uncover a recess portion which is formed in a mounting surface of an instrument panel or a side wall such as to accommodate therein articles.

Figure 1:
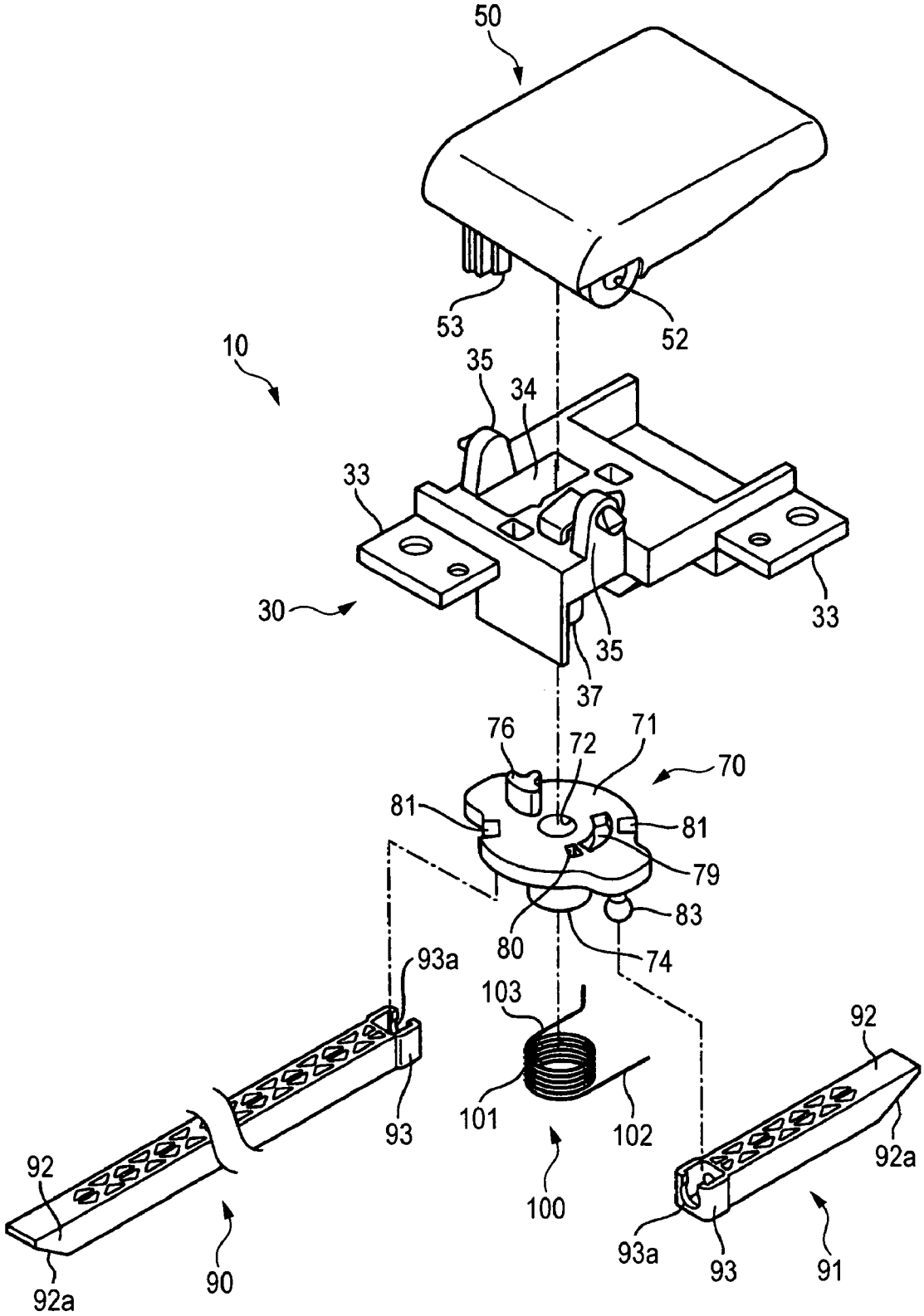
FIG. 1 is an exploded perspective view showing an embodiment of a side lock apparatus of the invention.

Referring to FIG. 1 and FIGS. 2A and 2B together, the side lock apparatus 10 of the invention 10 has a retainer 30 which is fixed to a rear side of the lid 2, a knob 50 which is supported on the retainer 30 in such a manner as to be pushed and pulled on and is disposed on a front side of the lid 2, a rotor 70 which is rotatably supported on a surface of an opposite side of the retainer 30 to a side thereof where the knob 50 is provided, a pair of rods 90, 91 which are brought into engagement with the rotor 70 point symmetrically with respect to an axial center of the rotor 70, and a return spring 100 which is mounted on the rotor 70 in such a manner as to rotationally bias the rods 90, 91 in a direction in which the rods 90, 91 are caused to protrude from both ends of the lid 2.

Figure 3A:
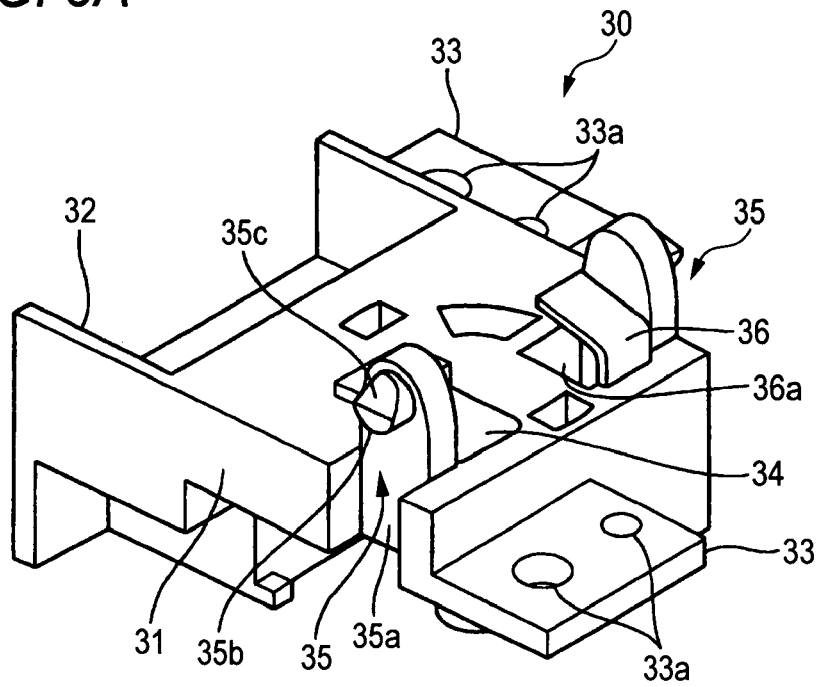

Referring also to FIG. 3A, the retainer 30 has on a front side thereof a base portion 31 on which a grabbing recess portion 32 is formed which facilitates the holding of the knob 50. Note that as a matter of convenience, the side of the retainer 30 where the knob 50 is mounted is understood to constitute the front side thereof. In addition, a plurality of mounting portions 33 each having two large and small mounting holes 33*a* are provided on side portions of the base portion 31, where by the retainer 30 is made to be fixed to a rear side of the lid 2.

A pusher element moving hole 34 which is formed into the shape of an elongated hole as shown in FIG. 1 is provided at a predetermined location on the base portion 31 in a longitudinal direction thereof in such a manner as to penetrate through the base portion 31. Furthermore, a pair of rotatably knob supporting portions 35, 35 are provided on both sides of the base portion 31 in a width ways direction in such a manner as to face each other across the pusher element moving hole 34. The rotatably knob supporting portions 35, 35 have support pieces 35*a*, 35*a* which are provided to erect from the base portion 31 and support shafts 35*b*, 35*b* which protrude from external sides of the support pieces 35*a*, 35*a*, respectively, and the support shafts 35*b*, 35*b* are inserted into shaft holes 52, 52 in the knob 50, which will be described later on, whereby the knob 50 is supported rotatably. As this occurs, a pusher element 53 of the knob 50 is inserted into the pusher element moving hole 34. Note that a tapered surface 35*c* is provided on an upper portion of the support shaft 35*c*, whereby the inserting property of the knob 50 into the shaft holes 52 is increased.

In addition, as is shown in FIG. 3A, a through hole 36*a* is provided in a position which is adjacent to an internal side of one of the rotatably knob supporting portions 35, and a looseness suppressive claw 36, which is bent into an L-shape, is provided in such a manner as to protrude from a circumferential edge of the through hole 36*a*. A looseness suppressive projection 56 on the knob 50, which will be described later on, is brought into abutment with the looseness suppressive claw 36, so as to suppress the looseness of the knob 50 (refer to FIG. 8). Note that since the looseness suppressive claw 36 deflects downwards when the knob 50 is pulled back, the push and pull operations of the knob 50 are enabled.

Figure 3B:
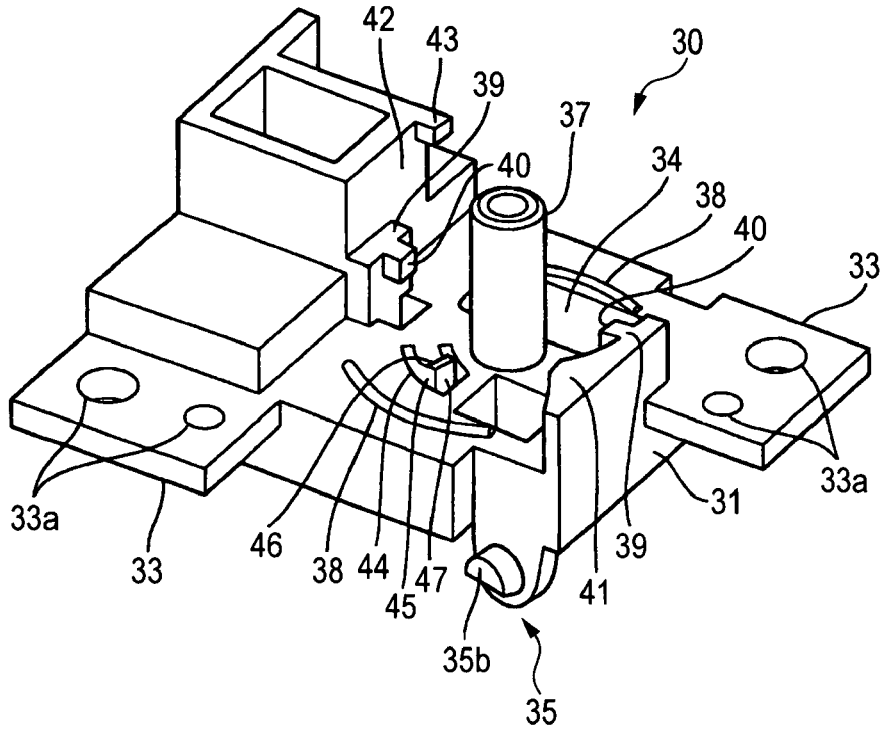

As is shown in FIG. 3B, a cylindrical rotatably rotor supporting portion 37, which constitutes a portion to be inserted into a shaft hole 72 and a rotational cylindrical portion 74 of the rotor 70 which will be described later on, is provided at a location on a rear side of the retainer 30 which lies adjacent to the pusher element moving hole 34 in such a manner as to protrude therefrom. Note that as a matter of convenience, the side of the retainer 30 where the rotor 70 is mounted is understood to constitute the rear side of the retainer 30.

Arc-shaped elongated projections 38 are provided in positions which lie in an outer circumferential area centered at the rotatably rotor supporting portion 37 and adjacent to the sides of the base portion 31 in the widthways direction in such a manner as to face each other, and furthermore, erectly standing walls 39, 39 are provided in positions which are shifted 90 degrees with respect to the elongated projections 38 in such a manner as to face each other. The erectly standing walls 39, 39 are situated further outwards than an external surface of a base plate 71 of the rotor 70, which will be described later on, and are caused to extend a length which exceeds the thickness of the rotor 70. Furthermore, claw portions 40, 40 are provided at distal ends of the erectly standing walls 39, respectively, in such a manner as to protrude towards the rotatably rotor supporting portion 37.

A surface of the rotor 70 is brought into abutment with the arc-shaped elongated projections 38, and on the other hand, the claw portions 40 pass through notched portions 81 in the rotor 70 so as to enable the rotor 70 to be pushed in relative to the retainer 30 and are brought into engagement with a rear surface side of the rotor 70.

Figure 6:
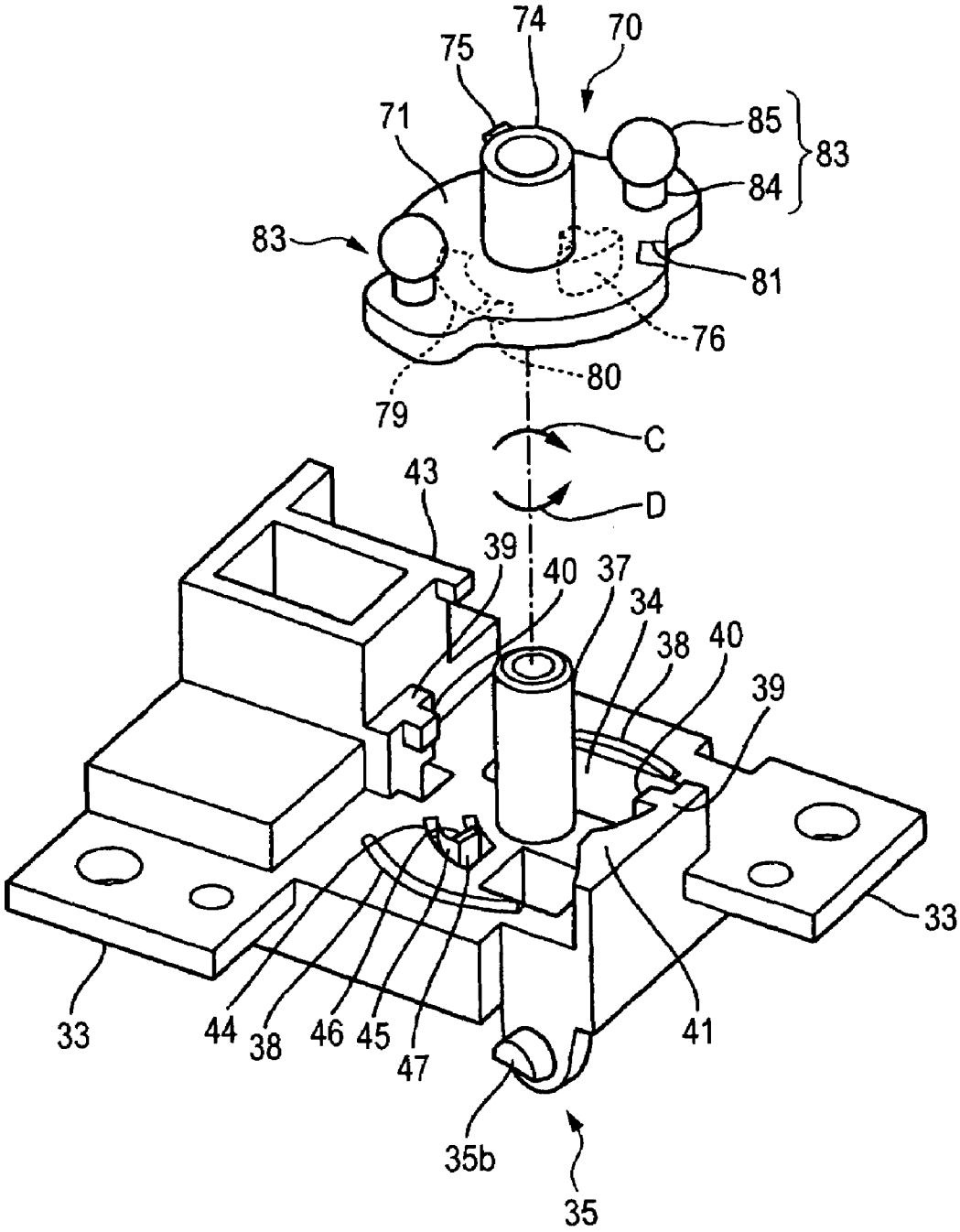
FIG. 6 is a perspective view which explains a procedure for assembling the rotor on to the retainer.

In addition, in order to restrict an unnecessary rotation of the rotor 70, one of the erectly standing walls 39 is formed integrally with a rotation restricting wall 41 which is provided to erect from a side end portion of the base portion 31 (refer to FIGS. 3B and 7), whereby the rotation of the rotor 70 in a direction indicated by an arrow D in FIG. 6 is attempted to be restricted. In addition, the other of the erectly standing walls 39 is formed integrally on a pedestal portion 42, and a projection 43 is provided at an upper portion of the pedestal portion 42 so that a leg portion 102 of the return spring 100 is hooked thereon (refer to FIG. 7).

Furthermore, a rotation restricting claw 45 is provided in the outer circumferential area of the rotatably rotor supporting portion 37 which lies opposite to the outer circumferential area where the pusher element moving hole is formed in such a manner as to protrude via a U-shaped slit, and a tapered surface 46 is formed on the side of a portion where the rotation restriction claw 45 is coupled to the base portion 31. When the rotor 70 is pushed on, the rotation restricting claw 45 is initially inserted into a recess portion 80 on the rotor 70, which will be described later on, and when the rotor 70 is caused to rotate, the rotation restricting claw 45 elastically deforms to move into an arc-shaped groove portion 79 to thereby attempt to restrict the rotation of the rotor 70 in directions indicated by arrows C, D in FIG. 6.

Figure 4A:
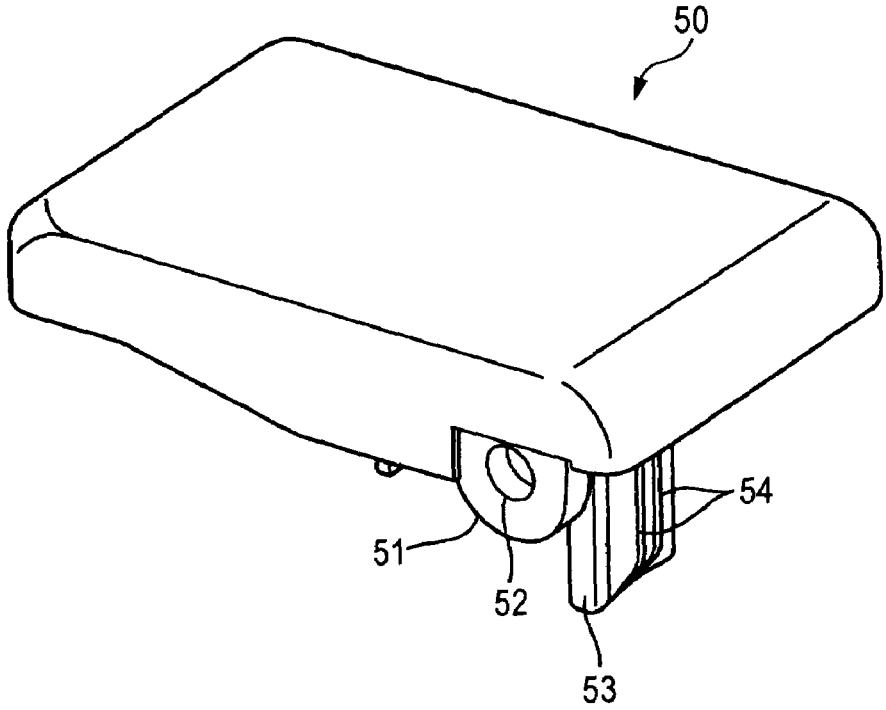
Figure 4B:
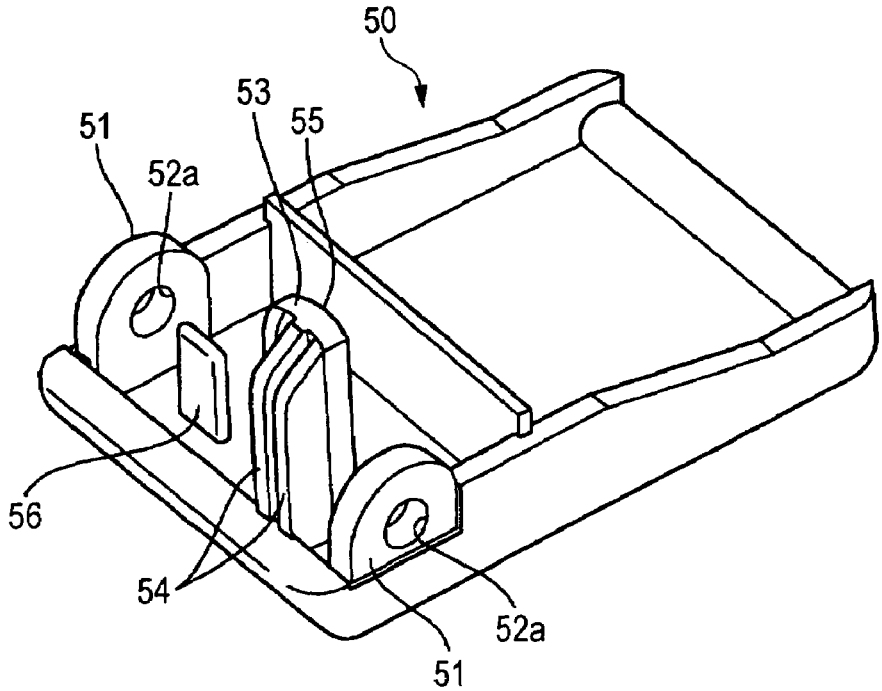

As is shown in FIGS. 4A and 4B, the knob 50, which is mounted on the front side of the retainer 30, is formed in such a size as to be accommodated in the mounting opening 3 in the lid 2, and support pieces 51, 51 having shaft holes 52 formed therein are provided on both sides of a distal end portion of the knob 50 in such a manner as to protrude therefrom, whereby the knob 50 is made to be mounted rotatably on the support shafts 35*b*, 35*b* of the retainer 30.

Figure 11A:
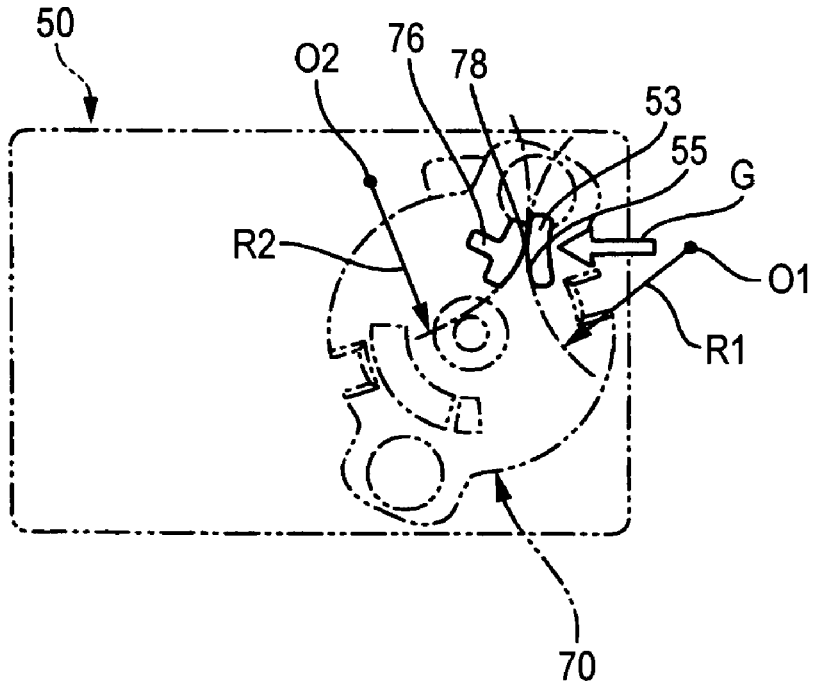

In addition, the pusher element 53 is provided to protrude from a location lying adjacent to an internal side of the support piece 51 in such a manner as to be brought into abutment with a bearing portion 76 of the rotor 70, which will be described later on. A side of the pusher element 53 which lies on the distal end side of the knob 50 is reinforced by ribs 54, and an arc-shaped contact surface 55 is formed on an opposite side of the pusher element 53 in such a manner as to be brought into contact with an arc-shaped contact surface 78 of the bearing portion 76, which will be described later on. As is shown in FIG. 11A, the contact surface 55 of the pusher element 53 is formed with a radius of curvature R1 relative to a center 01 and is set such that the radius of curvature R1 coincides with a radius of curvature R2 of the contact surface 78 of the bearing portion 76.

Figure 8:
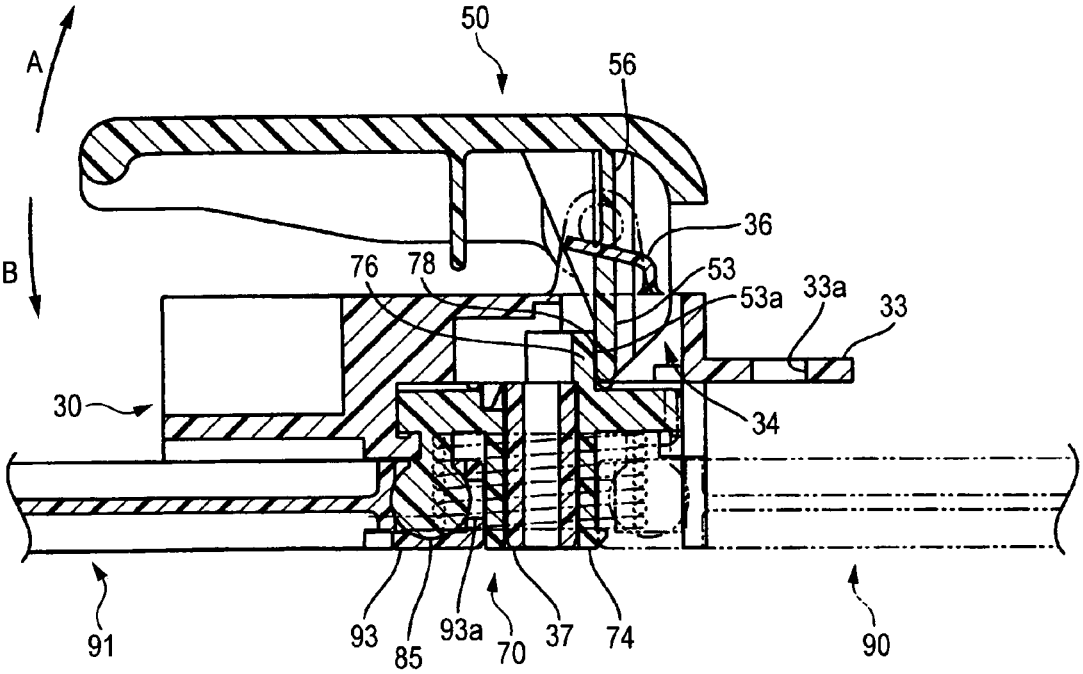
FIG. 8 is a sectional view of the main part of the side lock apparatus.

In addition, when the knob 50 is mounted on the retainer 30, the pusher element 53 is situated at the front of the pusher element moving hole 34 in the retainer 30 and is inserted in such a manner that the contact surface 55 faces inwards, and when the knob 50 is pulled back in a direction indicated by an arrow A in FIG. 8, the pusher element 53 is made to move from the front to the rear of the pusher element moving hole 34.

In addition, the looseness suppressive projection 56 is provided at a location lying adjacent to an internal side of the other support piece 51 in such a manner as to protrude therefrom, and the looseness suppressive projection 56 so provided is brought into abutment with the aforesaid looseness suppressive claw 36 of the retainer 30, so as to suppress looseness in such a state that the knob 50 is pushed in (refer to FIG. 8).

Figure 5A:
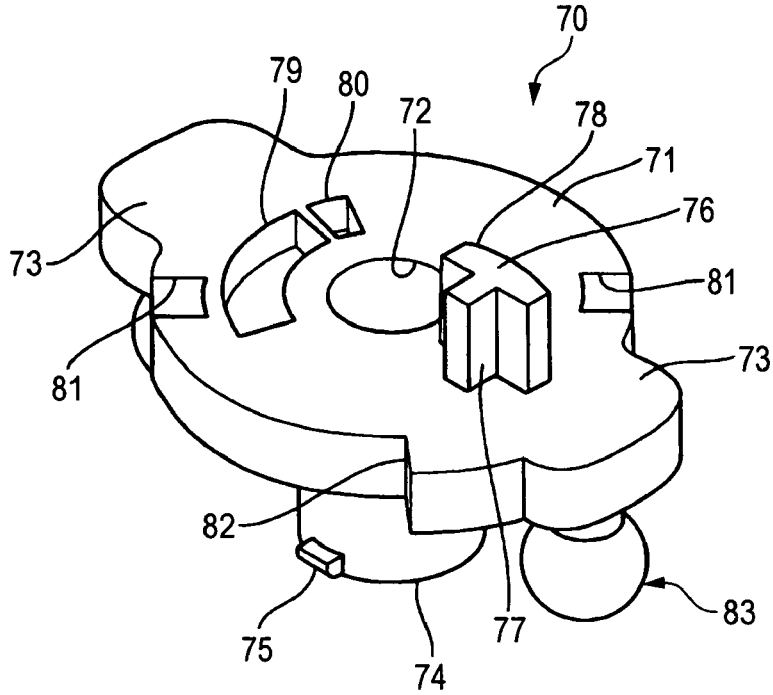
Figure 5B:
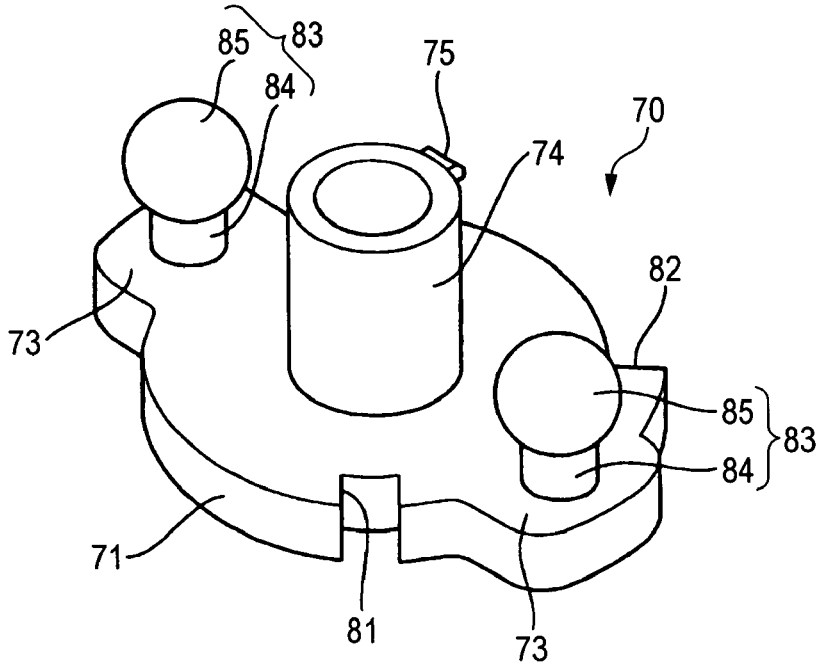

As is shown in FIG. 5A, the rotor 70, which is rotatably supported on the rear side of the retainer 30, has the circular base plate 71 in which the shaft hole 72 is formed at the center thereof and a pair of extending portions 73, 73 which are caused to extend radially outwards from facing portions on an outer circumference of the base plate 71. In addition, as is shown in FIG. 5B, the rotational cylindrical portion 74 which is formed into a cylindrical shape is provided on a rear side of the base plate 71 in such a manner as to protrude from a circumferential edge of the shaft hole 72. In addition, the rotatably rotor supporting portion 37 of the retainer 30 is inserted into the shaft hole 72 and the rotational cylindrical portion 74, so that the rotor 70 is supported rotatably relative to the retainer 30. Note that a projection 75 is provided at an upper portion of the rotational cylindrical portion 74 so as to constitute a dislodgement preventive means for preventing the dislodgement of a coil portion 101 of the return spring 100.

In addition, the aforesaid bearing portion 76, which is brought into abutment with the pusher element 53 of the knob 50, is provided at a predetermined location on an outer circumference of the shaft hole 72 in such a manner as to protrude therefrom. This bearing portion 76 is reinforced by a reinforcement rib 77 and the arc-shaped contact surface 78 is formed on an opposite side of the bearing portion 76, the arc-shaped contact surface 78 so formed constituting a portion which is brought into contact with the contact surface 55 of the pusher element 53. In addition, as is shown in FIG. 11A, the contact surface 78 of the bearing portion 76 is formed with the radius of curvature R2 relative to the center O2, which is made to coincide with the radius of curvature R1 of the contact surface 55 of the pusher element 53.

An arc-shaped groove portion 79, which is formed into an arc shape, is formed in a position on the outer circumference of the shaft hole 72 which faces the bearing portion 76, and the recess portion 80 is formed along the arc shape of the arc-shaped groove portion 79 at a predetermined interval from the arc-shaped groove portion 79. In addition, the notched portions 81, 81, which allows the passage of the claw portions 40 of the retainer 30, are provided on an outer circumferential edge portion of the base plate 71 at locations which face each other across the shaft hole 72 as the center, and furthermore, a hook portion 82 is formed on one side of the outer circumference of the base plate 71 so that a hook-shaped leg portion 103 of the return spring 100 is hooked thereon.

Then, for the rotor 70 to be assembled, when the notched portions 81, 81 are aligned with the claw portions 40 of the retainer 30 and the rotor 70 is pushed onto the retainer 30, the rotation restricting claw 45 is inserted into the recess portion 80, and furthermore, when the rotor 70 is caused to rotate in the direction indicated by the arrow D in FIG. 6, the rotation restricting claw 45 moves into the arc-shaped groove portion 79, and the claw portions 40 are brought into engagement with the rear side of the rotor 70, whereby the rotor 70 is supported rotatably. As this occurs, the bearing portion 76 of the rotor 70 is inserted and disposed within the pusher element moving hole 34 in such a state that the contact surface 78 thereof is oriented towards the front side of the pusher element moving hole 34 in the retainer 30 (refer to FIG. 8).

In addition, a pair of engagement portions 83, 83 are provided on the rear side of the rotor 70 in such a manner as to protrude from the extending portions 73, 73, respectively. This engagement portion 83 has a strut 84 which is provided in such a manner as to erect from the extending portion 73 and a spherical portion 85 which swells spherically from an upper end of the strut 84, and the engagement portions 83 are made to be brought into engagement with proximal end portions 93 of rods 90, 91 which will be described below.

As is shown in FIG. 1, the rods 90, 91 are made to be brought into engagement with and disengagement from a circumferential edge of the opening 6 (refer to FIG. 9, 10) in the instrument panel at distal end portions 92 thereof, whereas the rods 90, 91 are made to be brought into engagement with the engagement portions 83 of the rotor 70 at the proximal end portions 93 thereof. Note that in the case of this embodiment, the rod 91 is formed shorter than the rod 90. In addition, a tapered surface 92*a* is formed on one side of the distal end portion 92.

The proximal end portion 93 is made to open upwards and is formed into the shape of a frame which is sized such that the spherical portion 85 of the rotor 70 can be inserted thereinto. Furthermore, a notched portion 93*a* is provided in a front end face of the proximal end portion 93 in such a manner as to be notched into a substantially circular shape having an inside diameter which is slightly smaller than the spherical portion.85. Then, the spherical portions 85 of the rotor 70 which are inserted into the proximal end portions 93 are brought into abutment with circumferential edges of the notched portions 93*a*, whereby the rods 90, 91 are brought into engagement with the engagement portions 83, respectively.

The return spring 100 is made up of the coil portion 101 which is mounted on to the rotational cylindrical portion 74 of the rotor 70, the leg portion 102 which extends from one end of the coil portion 101 so as to be hooked on the projection 43 on the retainer 30 and the hook-shaped leg portion 103 which extends from the other end of the coil portion 101 so as to be hooked on the hook portion 82 on the rotor 70. The rotor 70 is rotationally biased in the direction indicated by the arrow C in FIG. 6 by mounting the return spring 100 on the rotor 70, whereby the respective distal end portions 92 of the rods 90, 91 are made to protrude from both ends of the lid 2. As this occurs, the bearing portion 76 of the rotor 70 is biased towards the front of the pusher element moving hole 34, resulting in a state where the bearing portion 76 is in elastic abutment with the pusher element 53 of the knob 50.

Next, the function and advantage of the side lock apparatus 10 of the invention will be described.

This side lock apparatus 10 is assembled as follows, for example. Note that the assembling order is not limited to an order which will be described below.

Firstly, the notched portions 81, 81 of the rotor 70 are aligned with the claw portions 40, 40 of the retainer 30, and as is shown in FIG. 6, the rotor 70 is pushed on to the retainer 30 from the rear side thereof, whereby the rotatably rotor supporting portion 37 is inserted into the shaft hole 72 and the rotational cylindrical portion 74 of the rotor 70, and the claw portions 40, 40 are made to protrude from the rear side of the rotor 70. As this occurs, the rotation restricting claw 45 of the retainer 30 is inserted into the recess portion 80 on the front side of the rotor 70. When the rotor 70 is caused to rotate in the direction indicated by the arrow D in this state, the tapered surface 46 is pressed by the recess portion, whereby the rotation restricting claw 45 is caused to deflect downwards, and when the rotation restricting claw 45 rides over the recess portion 80, the rotation restricting claw 45 is restored elastically so as to be inserted into the arc-shaped groove portion 79, and the claw portions 40, 40 are brought into engagement with a circumferential edge on the rear side of the rotor 70 (refer to FIG. 7).

In this way, the notched portions 81 of the rotor 70 are aligned with the claw portions 40 on the erectly standing walls 39 formed on the retainer 30, and after the rotor 70 is pushed on to the rotatably rotor supporting portion 37 on the retainer 30 so as to be mounted thereon, the rotor 70 is caused to rotate, whereby the rotor 70 can be held in such a state that the dislodgement thereof is prevented, and therefore, the mounting work of the rotor 70 on to the retainer 30 can be implemented easily and quickly.

As this occurs, since, when the rotor 70 is caused to rotate in the direction indicated by the arrow C, an erectly standing wall 47 formed on the rotation restricting claw 45 is brought into abutment with an inner circumference of an end portion of the arc-shaped groove portion 70 at its maximum rotation, a rotational rage of the rotor 70 in the direction indicated by the arrow C can be restricted. On the other hand, since, when the rotor 70 is caused to rotate in the direction indicated by the arrow D, one of the extending portions 73 of the rotor 70 is brought into abutment with the rotation restricting wall 41 on the retainer 30, a rotational range of the rotor 70 in the direction indicated by the arrow D can be restricted.

Next, the rotor 70 is caused to rotate so that the bearing portion 76 is situated at the rear of the pusher element moving hole 34 in the retainer 30, and the support shafts 35*b*, 35*b* of the rotatably knob supporting portions 35 are inserted into the shaft holes 52, 52 in the knob 50 from the front side of the retainer 30, whereby the knob 50 is mounted rotatably on the retainer 30. Then, the coil portion 101 of the return spring 100 is mounted on the rotational cylindrical portion 74 of the rotor 70, and the leg portion 102 is hooked on the projection 43 on the retainer 30, whereas the hook-shaped leg portion 103 is hooked on the hook portion 82 on the rotor 70, whereby the return spring 100 is mounted on the rotor 70, so as to rotationally bias the rotor 70 in the direction indicated by the arrow C.

Figure 7:
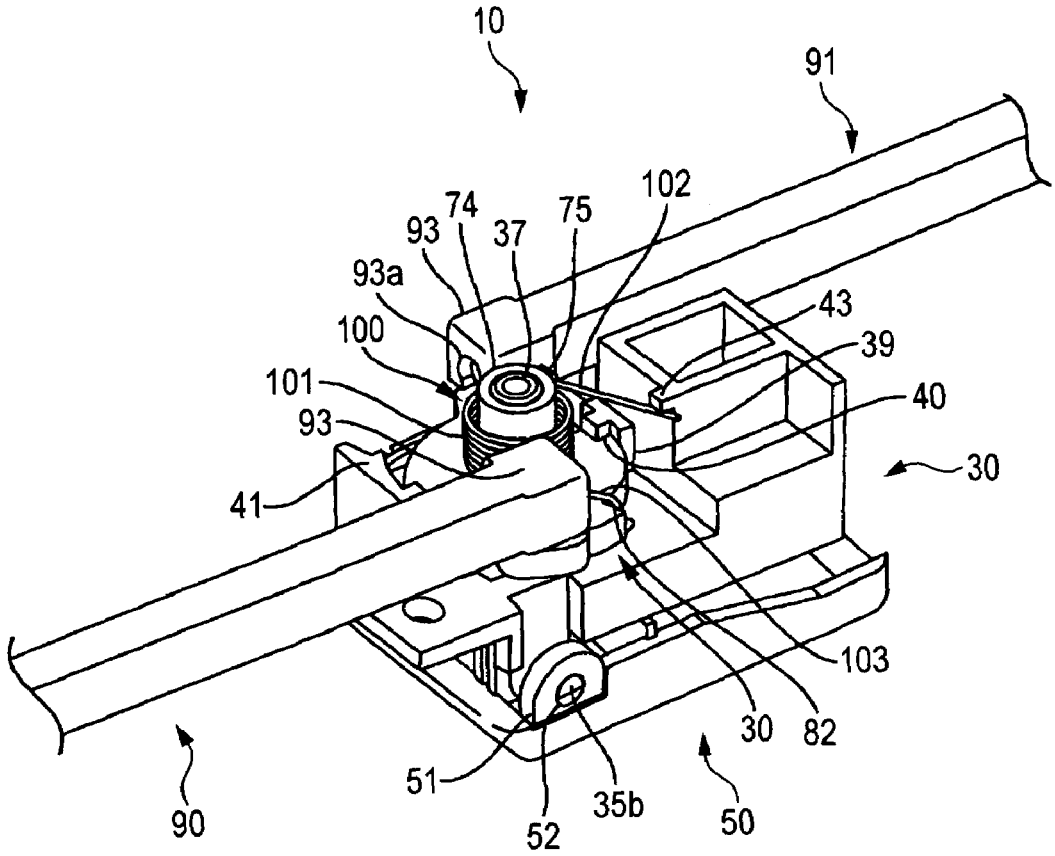
FIG. 7 is an enlarged perspective view of a main part of the side lock apparatus.

In this state, externally threaded screws are passed through the mounting holes 33*a* in the mounting portions 33 so as to be securely screwed into internally threaded holes on the rear side of the lid 2, which are not shown, whereby the retainer 30 is fixed to the circumferential edge of the mounting opening 3 on the rear side of the lid 2 via the mounting portions 33. As this occurs, when viewing from the front side of the lid 2, a state results in which the knob 50 is accommodated within the mounting opening 3. Then, by inserting the spherical portions 85 of the engagement portions 83 of the rotor 70 into the proximal end portions 93 of the rods 90, 91, as is shown in FIG. 7, the proximal end portions 93 of the pair of rods 90, 91 are brought into engagement with the rotor 70 at positions thereon which lie point symmetrically with respect to the axial center of the rotor 70. Thereafter, an inner cover 4 and an outer cover 5 are mounted on the rear side of the lid 2, whereby the mounting of the side lock apparatus 10 is completed (refer to FIG. 2).

In this way, in the side lock apparatus 10 of the invention, the rotor 70 and the knob 50 are assembled on to the retainer 30 in advance, and the rotor 70 and the knob 50 can be mounted only by fixing the retainer 30 to the rear side of the lid 2. Therefore, the efficiency of mounting work of the side lock apparatus 10 can be increased.

In addition, since the engagement portions 83 with the rods 90, 91 are provided on the rear side of the rotor 70, that is, the side of the rotor 70 which is opposite to the side thereof which faces the lid 2, the engagement portions 83 so provided are made difficult to interfere with the other members such as the knob 50 when the rotor 70 is operated to rotate, and the height of the side lock apparatus 10 when mounted is lowered as much as possible, thereby making it possible to attempt to make the side lock apparatus 10 smaller in size.

Thus, in the side lock apparatus 10 mounted on the lid 2, as is shown in FIG. 2, the distal end portions 92 of the rods 90, 91 are made to normally protrude from protruding openings 5*a* formed on both ends of the glove box 1 by virtue of the elastic biasing force of the return spring 100.

Then, when the lid 2 is pushed in to cover the opening 6 in the instrument panel, the tapered surfaces 92*a* of the rods 90, 91 are pressed against the circumferential edge of the opening 6, whereby the distal end portions 92 of the rods 90, 91 are withdrawn into the inside of the lid 2. Then, when the distal end portions 92 pass through the opening 6, the rods 90, 91 are restored elastically, and the distal end portions 92 are pushed out again so as to be brought into engagement of the circumferential edge of the rear side of the opening 6, whereby the lid 2 can be locked in a closed state (refer to FIG. 9).

Figure 9:
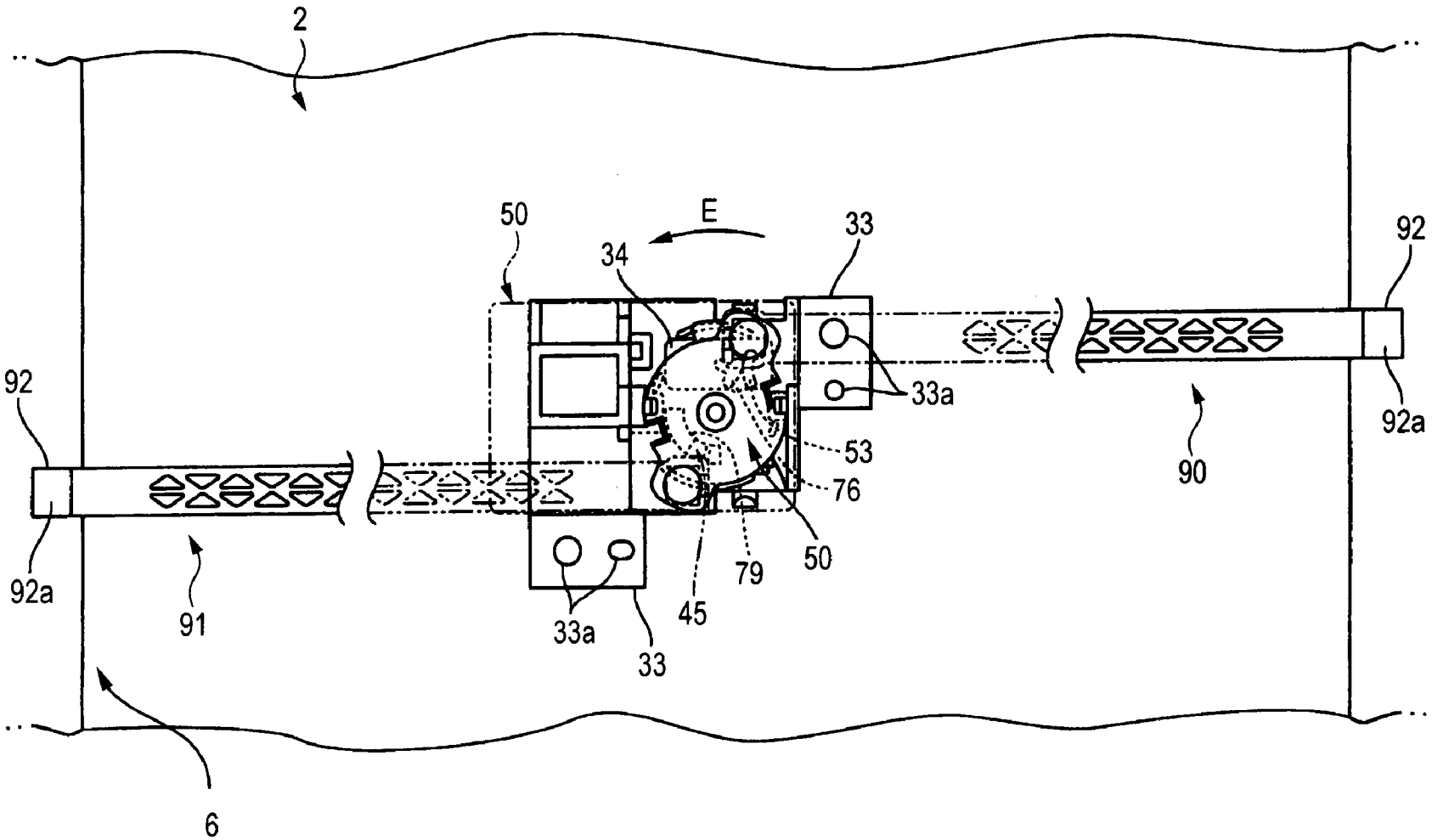
FIG. 9 is an explanatory diagram resulting when a state in which a lid is locked is seen from the inside of the lid.

When the knob 50 is pulled up to rise in the direction indicated by the arrow A in FIG. 8, the pusher element 53 of the knob 50 moves from the front to rear of the pusher element moving hole 34 and then comes to press against the bearing portion 76 of the rotor 70, whereby the rotor 70 can be caused to rotate in a direction indicated by an arrow E in FIG. 9 against the biasing force of the return spring 100. As a result, as is shown in FIG. 10, the rods 90, 91 are withdrawn into the inside of the lid 2, so as to release the engagement of the circumferential edge of the opening 6 with the distal end portions 92 of the rods 90, 91, thereby making it possible to cause the lid 2 to uncover the opening 6.

Figure 10:
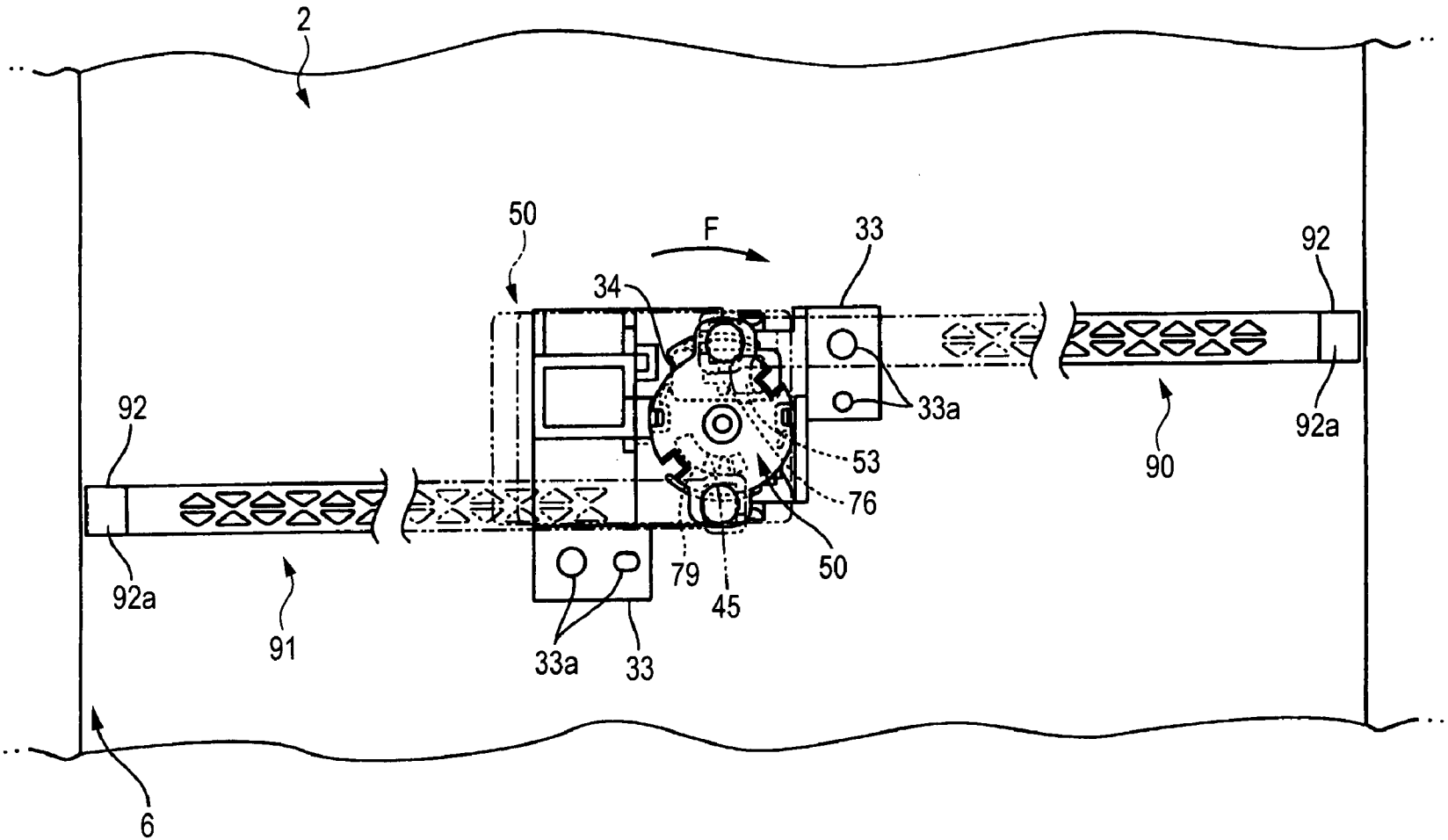
FIG. 10 is an explanatory diagram resulting when a state in which the lid is released from the locked state is seen from the inside of the lid.

In addition, when the pulling up of the knob 50 is completed, the rotor 70 rotates in a direction indicated by an arrow F in FIG. 10 by virtue of the biasing force of the return spring 100, and the bearing portion 76 moves from the rear to front of the pusher element moving hole 34 so as to press against the pusher element 53 of the knob 50, whereby the knob 50 is naturally pushed down in a direction indicated by an arrow B in FIG. 8, and the distal end portions 92 of the rods 90, 91 are caused to protrude from both the ends of the lid 2 again.

Since the lid 2 can be opened and closed through the push and pull operations of the knob 50 in which the knob 50 is pulled up and pushed down, the operation becomes easy, compared to a lock apparatus in which a lid is opened and closed through rotational operation. In addition, since the proximal end portions 93 of the rods 90, 91 are in engagement with the rotor 70 so that the pair of rods 90, 91 follow properly the rotation of the rotor 70 and hence operate at the same time as the rotation of the rotor 70 and there is produced no difference in operation stroke between the pair of rods 90, 91, there is produced neither play nor looseness when the knob 50 is operated, and hence, the opening and closing operation of the lid 2 can be implemented smoothly and securely.

In addition, in the side lock apparatus 10 of the invention, since the pusher element 53 protruding from the rear side of the knob 50 is made to be brought into abutment with the bearing portion 76 of the rotor 70, force applied from the knob 50 when the knob 50 is pushed and pulled on is transmitted to the rotor 70 effectively, whereby the operation of the rods 90, 91 and the opening and closing operation of the lid 2 can be implemented smoothly.

Furthermore, in the side lock apparatus 10 of the invention, as is shown in FIG. 11A, both the contact surface 55 of the pusher element 53 of the knob 50 and the contact surface 78 of the bearing portion 76 of the rotor 70 are formed into the arc shape, and the radius of curvature R1 of the contact surface 55 and the radius of curvature R2 of the contact surface 78 are made to coincide with each other. In addition, in the state in which the lid 2 is locked, a state results in which the pusher element 53 is in partial contact with the contact surface 78 of the bearing portion 76.

Figure 11B:
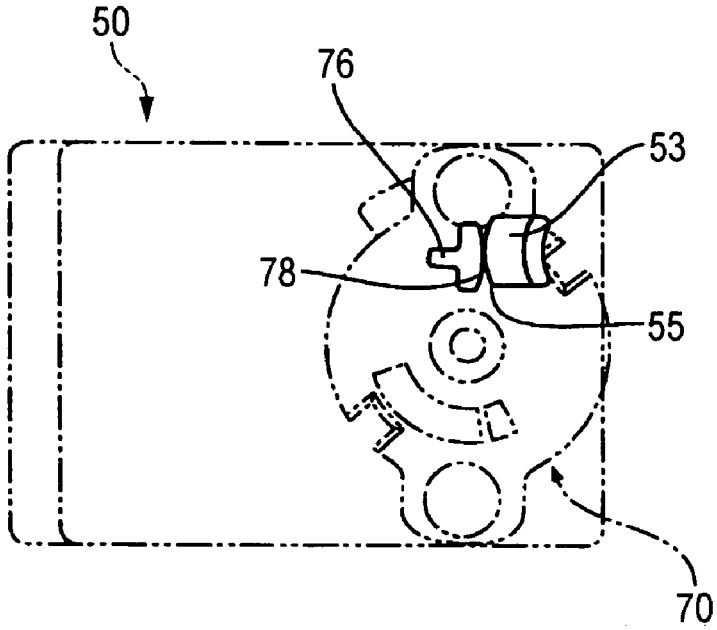

When the knob 50 is pulled up to rise in this state, the pusher element 53 moves in a direction indicated by an arrow G in FIG. 11A, and the bearing portion 76 is pressed against while in contact with the contact surface 55 of the pusher element 53 at all times in association with the movement of the pusher element 53. Namely, the bearing portion 76 is pressed against while in rolling contact with the contact surface 55 of the pusher element 53, and the rotor 70 is caused to rotate as shown in FIG. 11B.

Thus, even in the event that the rotor 70 rotates in association with the push and pull operations of the knob 50, no slippage is produced between the contact surfaces 55, 78, and the pusher element 53 of the knob 50 comes to press against the bearing portion 76 of the rotor 70 while in rolling contact therewith, whereby the frictional resistance is reduced to an extremely low level, and the knob 50 can be operated lightly. Moreover, the wear of the pusher element 53 of the knob 50 and the bearing portion 76 of the rotor 70 is small, and hence, the durability thereof can be increased.

In addition, in the side lock apparatus 10 of the invention, the arc-shaped elongated projections 38, 38 are provided on the rear side of the retainer 30 around the rotational center of the rotor 70 as the center. According to this configuration, since the contact area between the rotor 70 and the retainer 30 can be reduced so as to reduce the frictional resistance against the rotation of the rotor 70, the rotational operation of the rotor 70 can be implemented smoothly. In addition, since the engagement portions with the rods 90, 91 are provided on the sides of the extending portions 73, 73 of the rotor 70 which are opposite to the sides thereof which face the retainer 30, the inclination of the rotor 70 can be suppressed, so that the rods 90, 91 can be supported stably.

Note that while in the embodiment, the support shafts 35*b* are formed on the retainer 30, so as to be inserted into the shaft holes 52 of the knob 50 to rotatably support the knob 50, shaft holes or the like may be formed in the retainer 30, whereas support shafts or the like may be formed on the knob 50, so that the rotor 70 is supported rotatably. Similarly, support shafts may be provided on the rotor 70 in such a manner as to protrude therefrom, and shaft holes are formed in the retainer 30, so that the rotor 70 is supported rotatably. In addition, any other means may be adopted, provided that an object is not rotatably supported by a combination of support shafts and shaft holes but the knob 50 and the rotor 70 can be supported rotatably.

In addition, in the embodiment, the rotation restricting claw 45 provided on the retainer 30 and the arc-shaped groove portion 79 formed on the rotor 70 constitute the rotation restricting means of the invention.

Figure 12:
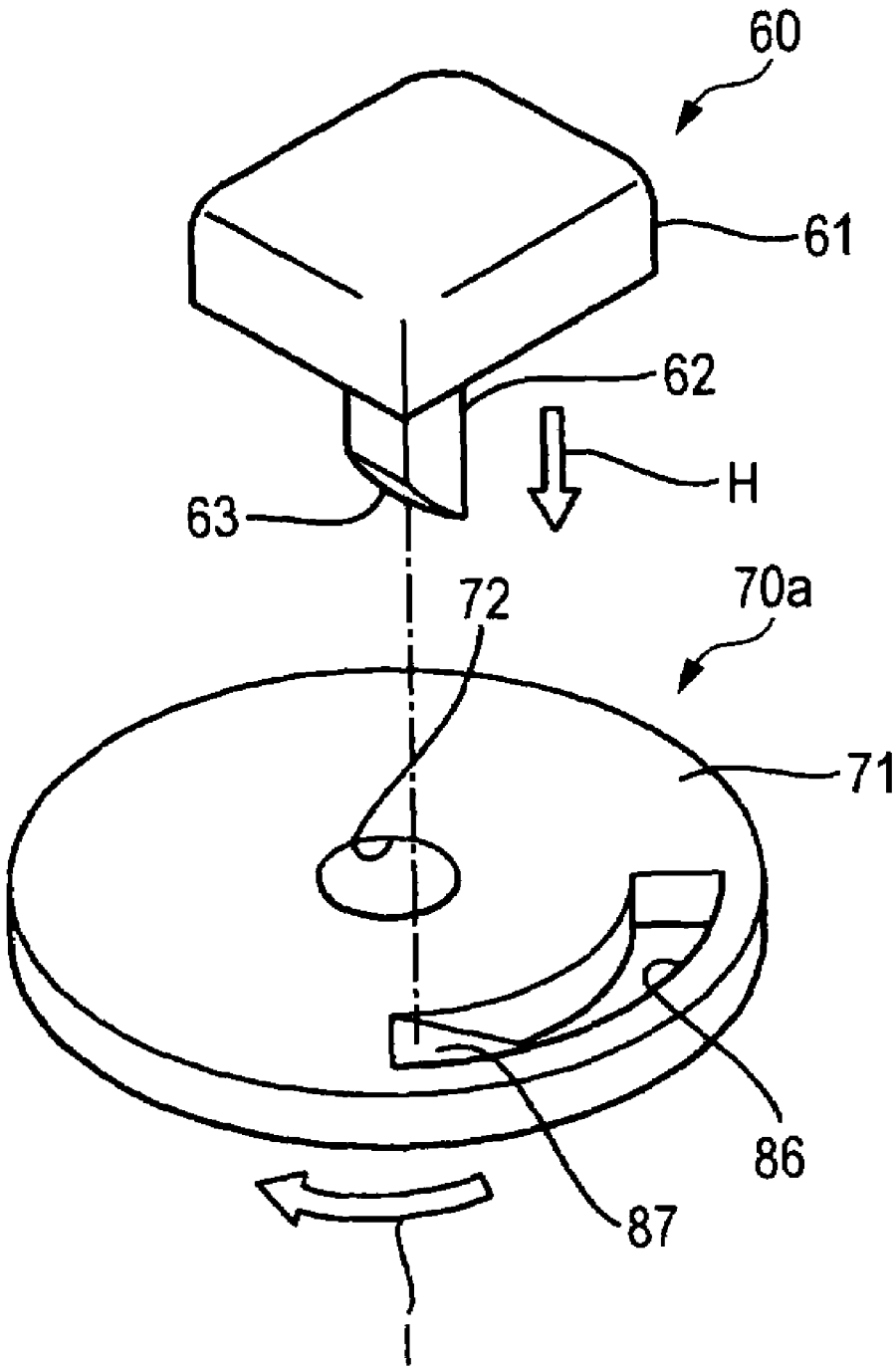
FIG. 12 is a perspective view showing another embodiment of a side lock apparatus of the invention.

FIG. 12 shows another embodiment of a side lock apparatus of the invention. Note that like reference numerals are given to substantially like portions to those of the embodiment that has been described above, and the description thereof will be omitted.

While only a main part of the embodiment is shown in FIG. 12, this embodiment differs from the previous embodiment in that a rotating means for rotating a rotor 70*a* is not a knob which is supported rotatably relative to a retainer 30 but a push-type knob. Note that as a matter of convenience, engagement portions with rods 90, 91 are omitted from the rotor 70*a*.

Namely, in this embodiment, an arc-shaped slit 86 is formed in the circular rotor 70*a* along an outer circumferential edge thereof, and a tapered surface 87 is formed at one end of the slit 86 in such a manner as to be gradually inclined from a lower end towards an upper end of the rotor 70*a* in a thickness-wise direction. In addition, a pushing knob 60 has a substantially rectangular base plate 61 and a pusher element

62 which is provided on a rear side of the base plate 61 in such a manner as to protrude therefrom, and one end of the pusher element 62 is cut obliquely upwards so as to be tapered downwards, an inclined pushing surface 63 being thereby formed. In addition, the pushing knob 60 is supported in such a manner as to come towards and go away from the rotor 70*a* in a vertical direction by a supporting member, not shown, and furthermore, the pushing knob 60 is normally biased in an elastic fashion in a direction in which the pushing knob 60 goes away from the rotor 70*a* by means of a spring or the like, not shown.

Then, when the pushing knob 60 is pushed downwards in a direction indicated by an arrow H in FIG. 12 against the biasing force of the spring, since the tapered surface of the rotor 70*a* is pushed gradually by the pushing surface 63 of the pusher element 62, the rotor 70*a* can be caused to rotate in a direction indicated by an arrow I, whereby the rods 90, 91 can be withdrawn into the inside of a lid 2. After the rods 90, 91 have been withdrawn in that way, the pushing knob 60 is pulled back in such a manner as to go away from the rotor 70*a* by virtue of the biasing force of the spring, and also in this embodiment, the push and pull operations can be performed.

Note that in this embodiment, the tapered surface 87 constitutes the bearing portion of the invention.

In addition, in the embodiment shown in FIGS. 1 to 11 and the embodiment shown in FIG. 12, while the pusher elements 53, 62 are formed into the protruding shape which protrudes from the rear side of the knob substantially vertically, the shape of the pusher elements is not limited thereto, provided that the corresponding bearing portion can be pushed on through the push and pull operations of the knob. Further, direction of the operation of the knob can be arbitrarily set.

What is claimed is:

1. A side lock apparatus for a lid for covering and uncovering an opening of a vehicle, the apparatus comprising:

a rotor rotatably supported on a rear side of the lid;

a pair of rods which are brought into engagement with engagement portions having positions which are point symmetrical relative to an axial center of the rotor at proximal end portions thereof and are supported in such a manner that distal end portions thereof appear from and disappear into both ends of the lid so as to be brought into engagement with and disengagement from a circumferential edge of the opening;

a knob mounted on a front side of the lid for the rotor to rotate, the knob comprising a pusher element for pushing on a bearing portion of the rotor;

a return spring mounted on the rotor such that the pair of rods are rotationally biased in respective directions in which the rods are caused to protrude from both ends of the lid; and a retainer, the retainer comprising:

a mounting portion which is fixed to the lid;

a knob supporting portion which rotatably supports the knob; and a rotor supporting portion which rotatably supports the rotor, wherein the knob and the rotor are mounted on the retainer, wherein the rotor rotates against a biasing force of the return spring by pulling on the knob, so that the rods are withdrawn into the lid, wherein the rotor comprises a pair of extending portions which are caused to extend radially outwards from facing portions on an outer circumference thereof, wherein an arc-shaped elongated projection which is centered at a rotational center of the rotor is provided on either of contact surfaces of the extending portions and the retainer, and wherein the engagement portions with the rods are provided on an opposite side of the extending portions to a side thereof where the extending portions are brought into contact with the retainer.

2. A side lock apparatus for a lid for covering and uncovering an opening of a vehicle, the apparatus comprising:

a rotor rotatably supported on a rear side of the lid;

a pair of rods which are brought into engagement with engagement portions having positions which are point symmetrical relative to an axial center of the rotor at proximal end portions thereof and are supported in such a manner that distal end portions thereof appear from and disappear into both ends of the lid so as to be brought into engagement with and disengagement from a circumferential edge of the opening;

a knob mounted on a front side of the lid for the rotor to rotate, the knob comprising a pusher element for pushing on a bearing portion of the rotor;

a return spring mounted on the rotor such that the pair of rods are rotationally biased in respective directions in which the rods are caused to protrude from both ends of the lid; and a retainer, the retainer comprising:

a mounting portion which is fixed to the lid;

a knob supporting portion which rotatably supports the knob; and a rotor supporting portion which rotatably supports the rotor.

wherein the knob and the rotor are mounted on the retainer, wherein the rotor rotates against a biasing force of the return spring by pulling on the knob, so that the rods are withdrawn into the lid, wherein the rotor comprises a notched portion at, at least, a location on a circumferential edge portion thereof, an erectly standing wall is provided on the retainer which is situated outwards of the rotor and is caused to extend over a length which exceeds the thickness of the rotor and which comprises at a distal end thereof a claw portion adapted to be brought into engagement with a rear surface side of the rotor, whereby when the rotor is mounted on the retainer, the claw portion is made to protrude to the rear surface side of the rotor through the notched portion, and the rotor is caused to rotate in that state, so that the claw portion is brought into engagement with a circumferential edge of the rotor to thereby prevent the dislodgement of the rotor, and wherein rotation restricting means is provided between the retainer and the rotor which prevents the return of the notched portion of the rotor to the claw portion of the retainer when the rotor is mounted on the retainer and is then caused to rotate and which permits the rotation of the rods within a predetermined angular range which enables the rods to appear from and disappear into both the ends of the lid.

* * * * *